US006079964A

United States Patent [19]

Custard

[11] Patent Number: 6,079,964

[45] Date of Patent: Jun. 27, 2000

[54] FLUID HANDLING DEVICE

[76] Inventor: John E. Custard, 4451 Herschel St., Jacksonville, Fla. 32234

[21] Appl. No.: 09/037,747

[22] Filed: Mar. 10, 1998

[51] Int. Cl.[7] ..... F01C 1/02

[52] U.S. Cl. ..... 418/61.3; 418/60; 418/54

[58] Field of Search ..... 418/61.3, 60, 54

[56] References Cited

U.S. PATENT DOCUMENTS

| | | | |
|---|---|---|---|
| 3,877,850 | 4/1975 | Berry | 418/68 |
| 4,101,248 | 7/1978 | Traut | 418/61.3 |
| 4,111,617 | 9/1978 | Gale et al. | 418/61.3 |
| 5,370,508 | 12/1994 | Barthod et al. | 418/61.3 |
| 5,380,177 | 1/1995 | Leroy et al. | 418/61.3 |

*Primary Examiner*—Thomas Denion
*Assistant Examiner*—Theresa Trieu
*Attorney, Agent, or Firm*—Steven R. Scott

[57] ABSTRACT

A fluid handling device capable of being used for numerous purposes, including use as an internal combustion engine or as a fluid pump, compressor, or expander, which fluid handling device is characterized in its preferred embodiments by: (a) a body with a spherical plenum; (b) a spherical member (which is located within said plenum); (c) two vane members lying in the same plane on opposing sides of said sphere exterior to said spherical plenum (which vane members have side edges that are perpendicular to the surface of said sphere); and (d) two cavities shaped like equilateral triangles with outwardly arcing walls on opposing sides of said sphere (the apex of one such triangle being positioned opposite the base of the other).

20 Claims, 11 Drawing Sheets

A
51A
51B
B
10
9
C

A
51A
5
B
9
7
C

A
51A
9
B
10
51C
C

A'
C'
11
10
13
12
9
B'

A'
C'
6
13
10
B'

A'
C'
13
10
9
B'

FLUID HANDLING DEVICE

BACKGROUND

1. Field of the Invention

The instant device relates generally to fluid handling devices for use as pumps, motors, expanders or compressors. More specifically, it relates to devices of this type featuring a spherical plenum. In particular, it relates to a fluid handling structure or device featuring an essentially spherical central member mounted in an essentially spherical plenum with the said spherical central member having vanes exterior to the spherical plenum, the device as a whole being capable of being used as a pump, expander, compressor, or an internal combustion engine.

2. Prior Art in the Field

There are, of course, numerous devices for use as fluid handling structures. However, few such devices feature spherical plenums and none known to the inventor feature spherical members mounted within such plenums with vanes exterior to the plenum. Examples of prior art in the same general field as the instant device may be found in the following patents:

1. U.S. Pat. No. 3,877,850 issued to Berry in 1975 for a SPHERICAL POWER DEVICE.
2. U.S. Pat. No. 3,934,559 issued to Cohen in 1976 for an ANTI-POLLUTANT SPHERICAL ROTARY ENGINE WITH AUTOMATIC SUPERCHARGER.
3. U.S. Pat. No. 4,354,807 issued to Shank et al. in 1982 for a COMPRESSOR-EXPANDER OF THE VANE TYPE HAVING CANTED VANE CAVITY.
4. U.S. Pat. No. 4,599,976 issued to Meuret in 1986 for a RECIPROCATING ROTARY PISTON THERMAL ENGINE WITH A SPHERICAL CHAMBER.

However, none of these patents teach devices rendering obvious the extremely novel features and applications of the fluid handling device described herein.

SUMMARY AND OBJECTS OF THE INVENTION

The instant invention relates to a fluid handling device which, in its preferred embodiments, has (a) a body with a spherical plenum; (b) a spherical member (which is located within said plenum); (c) two vane members lying in the same plane on opposing sides of said sphere exterior to said spherical plenum (which vane members have side edges that are perpendicular to the surface of said sphere); and (d) two generally tetrahedronal cavities on opposing sides of the sphere in which said vanes are located with each such tetrahedronal cavity having (i) its apex proximate the center of the spherical cavity, (ii) outwardly arcing walls, and (iii) triangular bases oriented in such manner that the apex of one such triangular base is positioned opposite the base of the other. The particular nature of the reciprocative rotation of the vane members within said cavities is unique, and creates oscillation as well as rotation of the spherical member. The overall device has a minimum of moving parts, and can be produced inexpensively using a variety of techniques well known in the mechanical arts for/from materials typically utilized for the production of pumps and internal combustion motors. Moreover, it may be utilized, with minor variations in design, for a variety of purposes, including use as (1) a highly efficient fluid pump, compressor, or expander; or (2) a highly efficient internal combustion engine. Thus, it represents a simple and unique design and advance over prior art devices for these same purposes, as well as one that may be readily and inexpensively produced.

DETAILED DESCRIPTION OF THE PREFERRED EMBODIMENT

Figure 1:
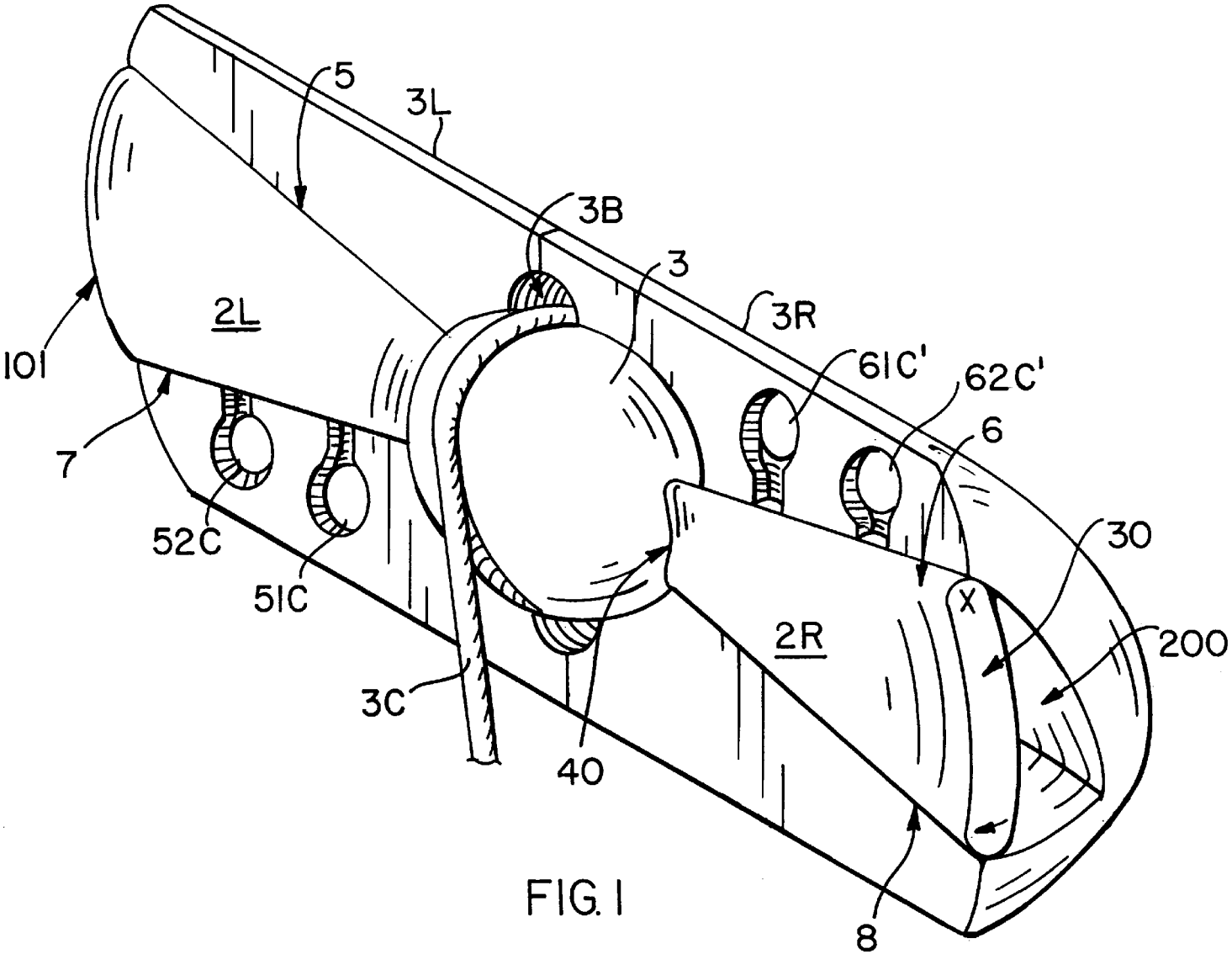
FIG. 1 provides a perspective view, partially cut-away and with heads removed, of a first preferred embodiment of the instant invention intended for use as an internal combustion engine.

As illustrated in FIGS. 1 through 10, the preferred embodiments of the instant invention (denoted generally by arrow 1) are characterized by the presence of two generally wedge shaped vane members. The orientation of these vane members (and other elements of the invention designated as "left" or "right") in the drawing figures is, of course, purely arbitrary. However, for ease of understanding and reference to the drawing figures they are referred to as "left" or "right" members. Thus, it will be noted that left vane 2L and right vane 2R are mounted on opposite sides of a sphere 3. Sphere 3 has a centerpoint (denoted generally by arrow 3A) which serves as the centerpoint of all spherical surfaces (hypothetical and actual) named below, the center from which all radial lines (hypothetical and actual) named below emanate, and the center of rotation for the sphere 3. Power input and output may be transferred to/from sphere 3 via a belt, roller chain, gears, or a universal joint. (In the embodiments illustrated, this is accomplished via belt 3C nested in annular groove 3B). However, it should be remembered that the sphere 3 oscillates as well as rotating. Thus, a universal joint would also have utility for this purpose.

Figure 2:
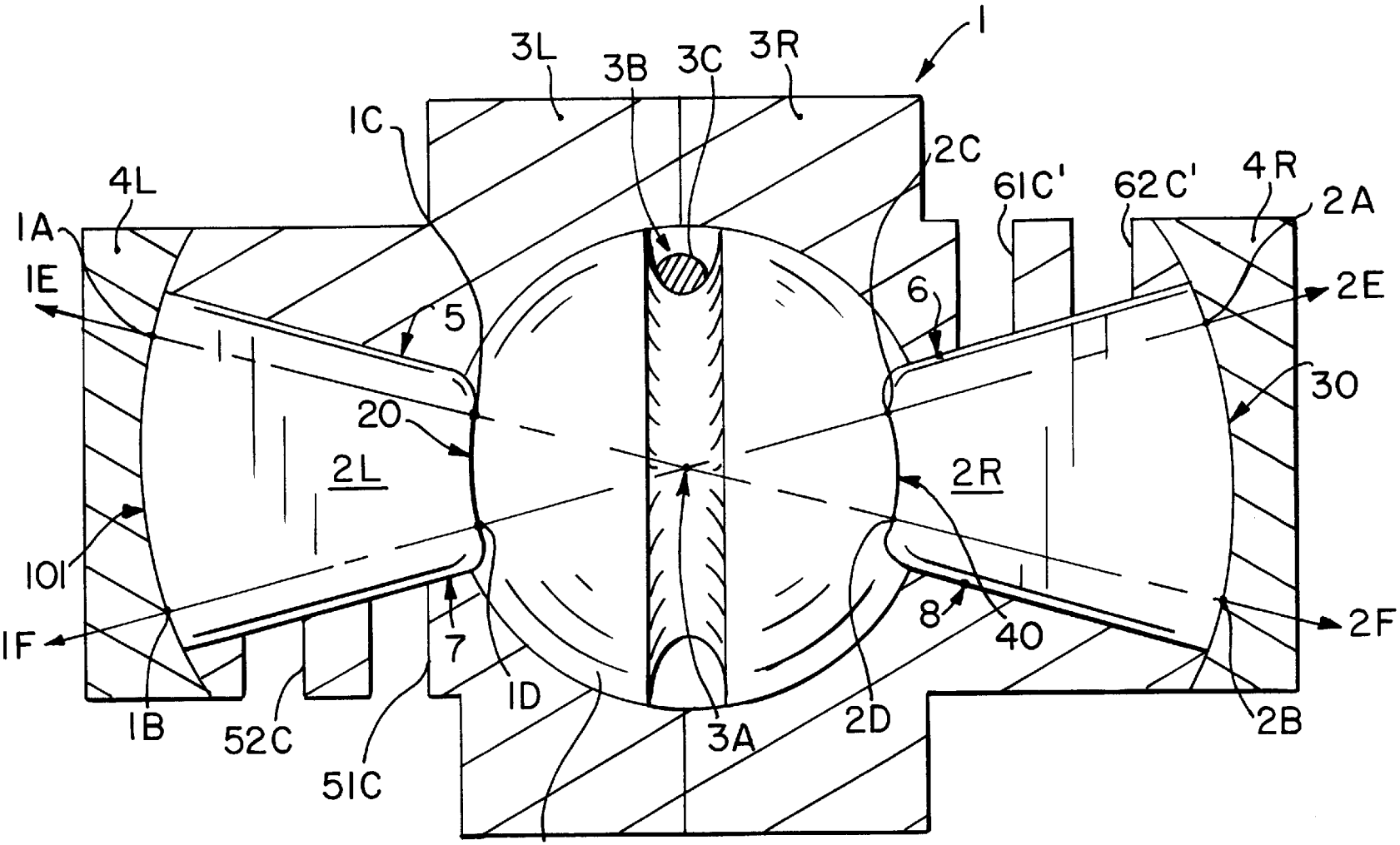
FIG. 2 provides a partially cross-sectional view of a second preferred embodiment of the instant invention showing vanes and sphere from the side and remaining portions in cross-section.
Figure 5A:
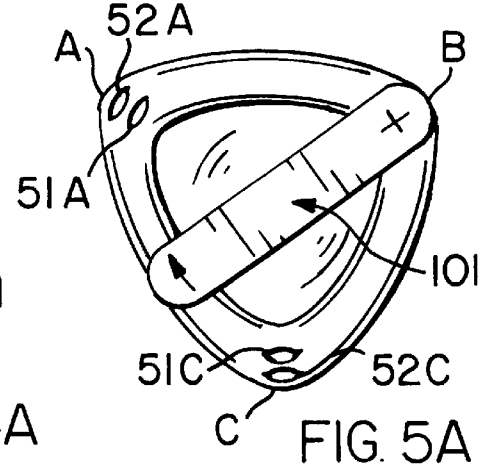
FIG. 5A provides a view from the left of the left vane cavity of a second preferred embodiment of the instant invention with the left vane in a third position.
Figure 4A:
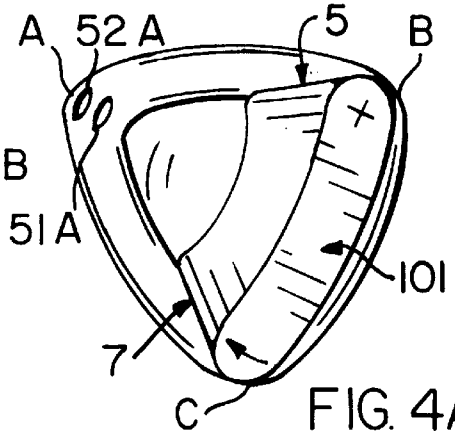
FIG. 4A provides a view from the left of the left vane cavity of a second preferred embodiment of the instant invention with the left vane in a second position.
Figure 3A:
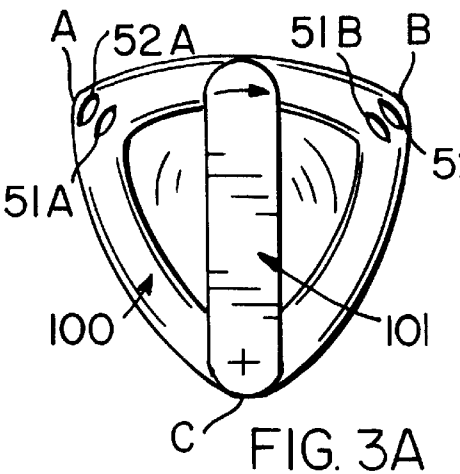
FIG. 3A provides a view from the left of the left vane cavity of a second preferred embodiment of the instant invention with the left vane in a first position.
Figure 5B:
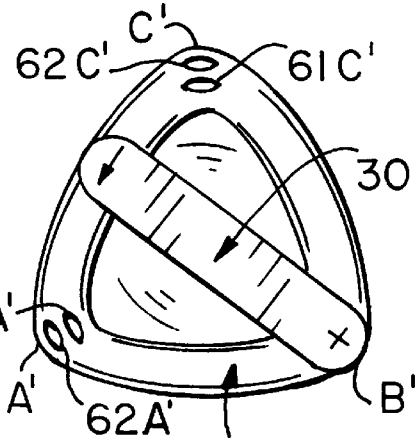
FIG. 5B provides a view from the right of the right vane cavity of a second preferred embodiment of the instant invention at the same point in time as FIG. 5A, showing the right vane in a third position.
Figure 4B:
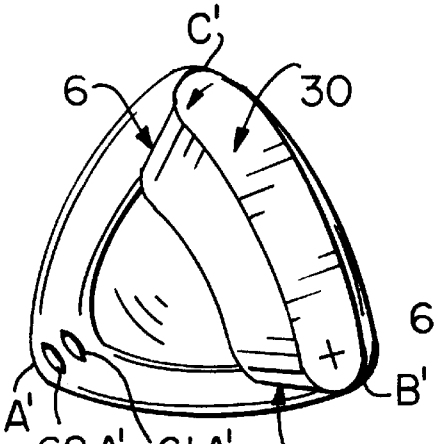
FIG. 4B provides a view from the right of the right vane cavity of a second preferred embodiment of the instant invention at the same point in time as FIG. 4B, showing the right vane in a second position.
Figure 3B:
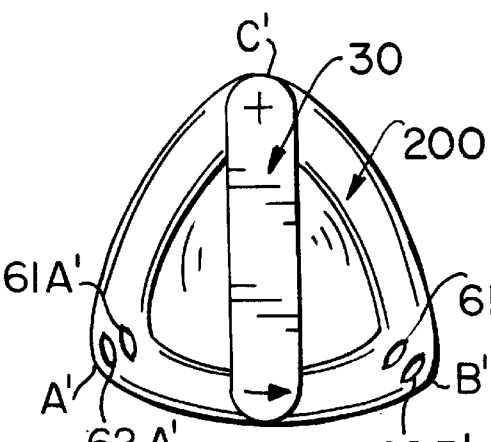
FIG. 3B provides a view from the right of the right vane cavity of a second preferred embodiment of the instant invention at the same point in time as FIG. 3A, showing the right vane in a first position.
Figure 6:
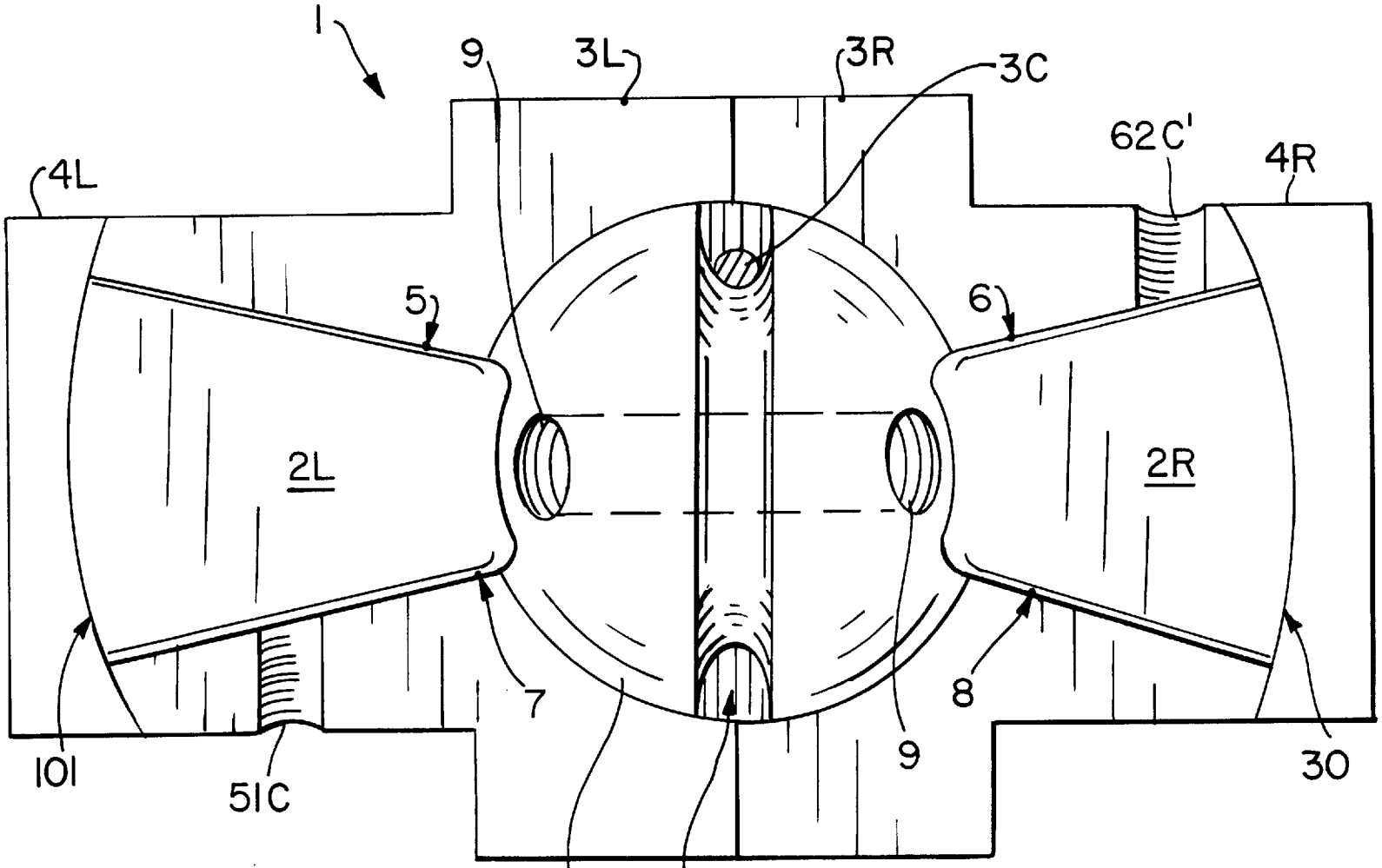
FIG. 6 provides a partially cut-away view of a third preferred embodiment of the instant invention, showing vanes and sphere from the side and remaining portions in cut-away section.
Figure 9A:
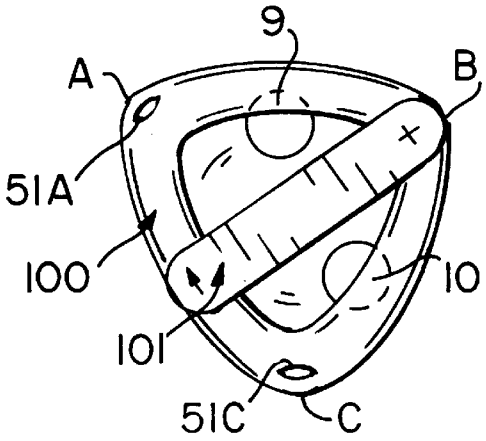
FIG. 9A provides a view from the left of the left vane cavity of a third preferred embodiment of the instant invention with the left vane in a third position.
Figure 8A:
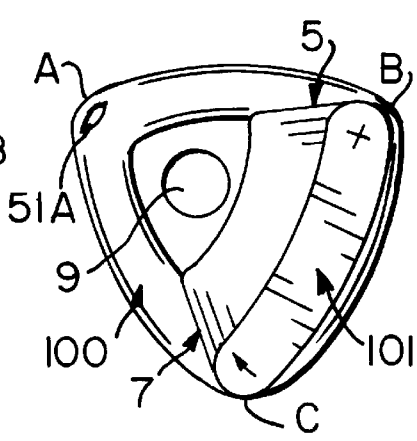
FIG. 8A provides a view from the left of the left vane cavity of a third preferred embodiment of the instant invention with the left vane in a second position.

Certain features of the instant invention can best be understood by reference FIGS. 1, 2, 6 and 10 with particular reference to FIG. 2, where certain center lines and points of reference are alone illustrated. The purpose of such illustration is to provide a better understanding of the geometric features and symmetries of the instant invention. They are omitted in other drawing features as unnecessary (the basic concepts relevant to same being illustrated in FIG. 2) and to avoid overcrowding of said drawing figures. Turning to FIG. 2, it will be noted that left vane 2L and right vane 2R lie on opposite sides of sphere 3 in a plane containing center point 3A. Each is disposed within a cavity in which it rotatively reciprocates, left vane 2L in a left vane cavity (denoted by arrow 100) and right vane 2R in a right vane cavity (denoted by arrow 200). Left vane 2L has an outward edge (denoted by arrow 101) essentially shaped like an arc between a first point 1C and a second point 1B on the surface of a first hypothetical sphere, and an inward edge (denoted by arrow 20) essentially shaped like an arc between a third point 1C and a fourth point 1D on the surface of sphere 3, sphere 3 being concentric with and smaller than said first hypothetical sphere. The inward edge 20 also lies in a hypothetical plane containing said outward edge 101. Likewise, second vane 2 has an outer edge 30 essentially shaped like an arc between a first terminus 2A and a second terminus 2B on the surface of a second hypothetical sphere, and an inner edge 40 essentially shaped like an arc between a third terminus 2C and a fourth terminus 2D on the surface of sphere 3, sphere 3 being concentric with and smaller than said second hypothetical sphere. Inner edge 40 lies in a hypothetical plane containing outer edge 30 as well as inward edge 20 and outward edge 101.

The side edges (denoted by arrows 5 and 7) of left vane 2L and the side edges (denoted by arrows 6 and 8) of right vane 2R may advantageously take the shape of a half cylinder (as illustrated in the drawing figures) or of a half cone segment. If conical, the larger end of the cone may be towards sphere 3 or away from same. In any case, as will be observed from FIG. 2 and the other drawing figures, the center lines (as denoted below) of said cone or cylinder shaped side edges 5, 6, 7 & 8, form radii of sphere 3. Thus, as to left vane 2L, a first side center line (denoted as arrow 1E) runs between said first point 1A and said third point 1C and lies on a hypothetical radius from said center point 3A. Likewise, a second side center line (denoted as arrow 1F) runs between said second point 1B and said fourth point 1D and also lies on a hypothetical radius from said center point 3A. Further, as to right vane 2R, a primary side center line (denoted as arrow 2E) runs between said first terminus 2A and said third terminus 2C and lies on a hypothetical radius from said center point 3A. Moreover, a secondary side center line (denoted as arrow 2F) runs between said second terminus 2B and said fourth terminus 2D and also lies on a hypothetical radius from said center point 3A.

The body 1 of the invention in the preferred embodiments illustrated is formed from two sections, hereinafter referred to left section 3L and right section 3R, joined together to form a spherical plenum in which sphere 3 is disposed. Left section 3L contains left vane cavity 100 which has three arcuate planar sides. Right section 3R likewise contains right vane cavity 200 having three arcuate planar sides. Each of said arcuate planar sides is shaped like a portion of the surface of a cone. The side angle of this hypothetical cone would be equal, in left vane cavity 100, to an angle defined by the intersection of a first line segment connecting said first point 1A to said third point 1C and a second line segment connecting said first point 1A to said second point 1B. Likewise, in right vane cavity 200, the side angle of this hypothetical cone would be equal to an angle defined by the intersection of a line segment connecting said first terminus 2A to said third terminus 2C and a line segment connecting said first terminus 2A to said second terminus 2B. As may be better seen in FIGS. 3A through 5B, 7A through 9C, and 11A through 17B, the corners A, B, and C, of left vane cavity 100 and the corners A', B', and C', of right vane cavity 200 are rounded so as to match and interface with the half cylindrical or half conical side edges of the vane contained therein.

The left section 3L and the right section 3R are capped by, respectively, left head 4L and right head 4R. As will be noted, the portion of left head 4L located above left vane cavity 100 is shaped like a portion of the first hypothetical sphere bounding outward edge 101. Likewise, the portion of right head 4R located above right vane cavity 200 is shaped like a portion of the second hypothetical sphere bounding outer edge 30. Left head 4L and right head 4R are fitted to their respective sections so as to form a seal therebetween. With this understanding of the general structure of the invention it will now be possible to examine how the invention functions in the different applications illustrated in FIG. 2 and the other drawing figures and discussed below.

The prototypical embodiment illustrated in FIGS. 2 through 5B is suitable for use as a single stage compressor or pump. In this embodiment, two apertures accessed via one-way valves (not shown), one for intake and one for exhaust, would be placed in each corner. Thus, left vane cavity 100 is accessed: (1) in corner A by intake 51A and exhaust 52A); (2) in corner B by intake 51B and exhaust 52B; and (3) in corner C by intake 51C and exhaust 52C. Likewise, right vane cavity 200 is accessed: (1) in corner A' by intake 61A' and exhaust 62A'; (2) in corner B' by intake 61B' and exhaust 62B'; and (3) in corner C' by intake 61C' and exhaust 62C'. (In order to better follow the motion of the left vane 2L and the right vane 2R in this application and those that follow, the moving/sweeping edge of the vane at any point in its cycle of reciprocative rotation has inscribed thereon an arrow indicating the direction of its movement while the fixed/pivoting side of the vane at any point in said cycle has an "X" located thereon). As will be noted from review of drawing FIGS. 3A through 5B (and equivalent figures for the applications that follow), when an edge in one cavity is temporarily serving as the fixed/pivoting edge, the opposite edge on the other side (i.e.-the edge that would lie along a straight line drawn through the centerpoint 3A) is also serving as a fixed/pivoting edge in the other cavity. Likewise, when an edge in one cavity is temporarily serving as the moving/sweeping edge, the opposite edge on the other side is also serving as a moving/sweeping edge in the other cavity. Thus, as left vane 2L and right vane 2R pivot in corners C and C', respectively, side edge 5 is sweeping from A to B while side edge 8 sweeps from A' to B', taking in fluid from the one-way intake 51A at corner A and the one-way intake 61A' at corner A' while, at the same time, exhausting fluid through one-way exhaust 52B at corner B and one-way exhaust 62B' at corner B'. (See, FIGS. 3A and 3B). When side edge 5 of left vane 2L reaches B and side edge 8 of right vane 2R reaches B', they stabilize smoothly to become the fixed/pivoting edges. This allows the rotational motion of the sphere 3 and the left vane 2L to continue such that side edge 7 begins to move/sweep from corner C to corner A, drawing fluid in via intake 52C at corner C and exhausting same via exhaust 52A at corner A. Likewise, the side edge 6 of the right vane 2R begins to move/sweep from corner C' to corner A', drawing fluid in via intake 61C' at corner C' and exhausting same via exhaust 62A' at corner A'. This corner-to-corner movement is repeated in every 60 degrees of sphere 3 rotation. Thus, each cavity/vane goes through 6 intake/exhaust strokes for each complete cycle of sphere 3 for a total of 12 intake strokes and 12 exhaust strokes per rotation for the embodiment shown.

FIGS. 6 through 9B illustrate an embodiment in which the apparatus 1 is utilized as part of a two stage air compressor. In this embodiment the left vane 2L and left vane cavity 100 are larger than the right vane 2R and the right vane cavity 200. As before, left vane cavity 100 has intake apertures accessed via one-way inlet valves (not shown) at corner A (intake 51A), corner B (intake 51B), and corner C (intake 51C). Right vane cavity 200, likewise, has exhaust apertures accessed via one-way exhaust valves (not shown) in corner A' (exhaust 62A'), corner B' (exhaust 62B'), and corner C' (exhaust 62C'). Sphere 3 is provided with a first port hole 9 and a second port hole 10 located on opposite sides of the first vane 1 and the second vane 2 and parallel thereto. First port hole 9 and second port hole 10 each are provided with a one-way valve (not shown) allowing air to pass therethrough only from the larger left vane cavity 100 to the smaller right vane cavity 200.

Figure 7A:
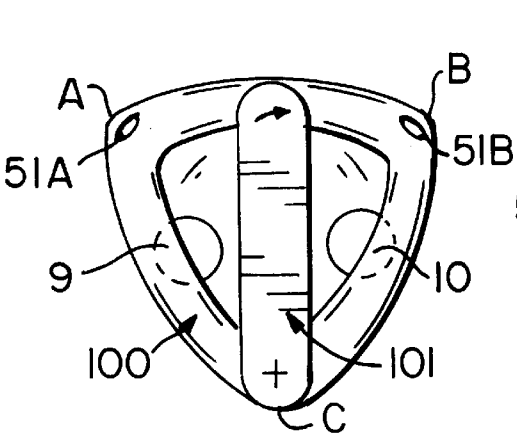
FIG. 7A provides a view from the left of the left vane cavity of a third preferred embodiment of the instant invention with the left vane in a first position.
Figure 9B:
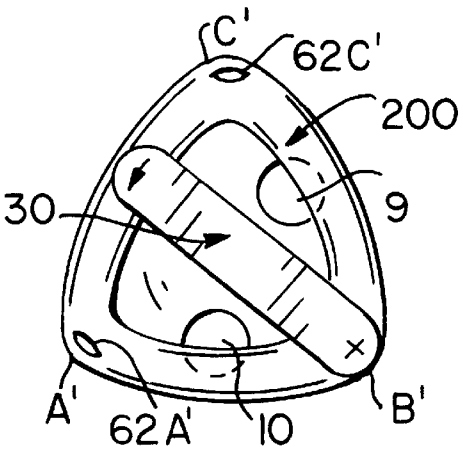
FIG. 9B provides a view from the right of the right vane cavity of a third preferred embodiment of the instant invention at the same point in time as FIG. 9A, showing the right vane in a third position.
Figure 8B:
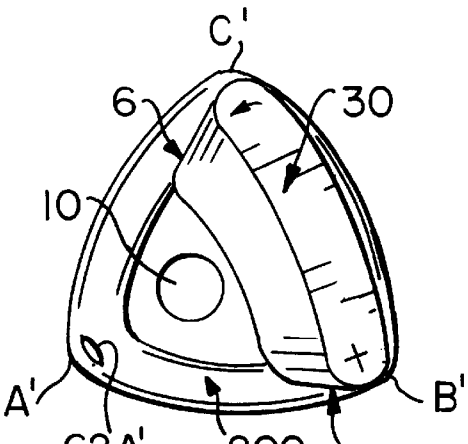
FIG. 8B provides a view from the right of the right vane cavity of a third preferred embodiment the instant invention at the same point in time as FIG. 8A, showing the right vane in a second position.
Figure 7B:
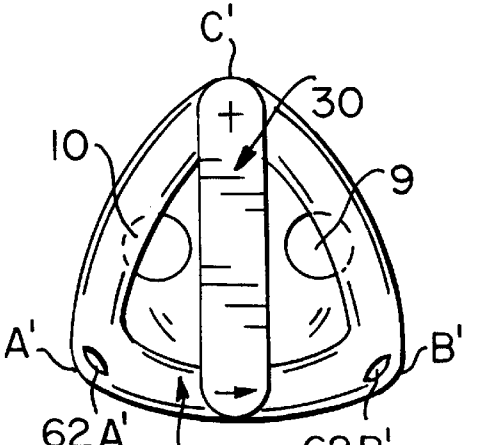
FIG. 7B provides a view from the right of the right vane cavity of a third preferred embodiment of the instant invention at the same point in time as FIG. 7A, showing the right vane in a first position.

The operation of this device can best be understood by examination of FIGS. 7A through 9B. As illustrated in FIG. 7A, when left vane 2L pivots on edge 7 (allowing edge 5 to sweep between corner A and corner B), air is drawn into left vane cavity 100 via intake 51A in corner A while compressing air through second port hole 10 into right vane cavity 200. Meanwhile, as illustrated in FIG. 7B, right vane 2R pivots on edge 6 (allowing edge 8 to sweep between corner A' and corner B') exhausting air previously compressed through exhaust 62B' at corner B'. Then, as illustrated in FIGS. 8A through 9B, left vane 2L pivots at corner B, sweeping from corner C to corner A, compressing air through first port hole 9 into right vane cavity 200 and taking air in via intake 51C at corner C. Meanwhile, the smaller right vane 2R sweeps from corner C' to corner A', exhausting air via exhaust 62A' at corner A'. The corner-to-corner reciprocative rotation of the vanes discussed above will continue and be repeated in every 60 degrees of rotation of sphere 3. Thus, left vane cavity 100 will have six intake strokes and six compression strokes pressurizing the six intake strokes of right vane cavity 200 for every sixty degrees of rotation of sphere 3. Right vane cavity 200 will, in turn, have six exhaust strokes of right vane cavity 200 per revolution. Each of these exhaust strokes can serve to further compress the air taken in from left vane cavity 100.

Preferred embodiments useful as internal combustion engines (either gas or diesel) are illustrated in FIGS. 10 through 13B (for a two stroke engine) and FIGS. 1 and 14A through 17B (for a four stroke engine). In both embodiments there are six (6) power strokes per revolution of sphere 3. Moreover, both embodiments provide substantial mechanical advantage over conventional piston-type internal combustion engines. Conventional internal engines transfer power indirectly through a piston connecting rod to a rotating crankshaft where, during large parts of each stroke, the angle between these members is disadvantageous for maximum power transfer. In the instant invention, power derived from internal combustion directly effects rotation of sphere 3 without such intervening members, resulting in the transfer of all effective power from internal combustion to rotation.

In the two-stroke embodiment illustrated in FIGS. 10 through 13B, the left vane 2L and left vane cavity 100 are, as in the previous embodiment, larger than the right vane 2R and the right vane cavity 200. As in the prior embodiment illustrated, a first port hole 9 and a second port hole 10 parallel to the plane containing left vane 2L and right vane 2R are provided, and each of these ports has a one-way valve allowing passage of gases only from the larger left vane cavity 100 to the smaller right vane cavity 200. (This one-way valve would preferably, as to both first port hole 9 and second port hole 10, be located proximate to left vane cavity 100 as each of these port holes serves, as discussed below, to store compressed air during certain portions of the internal combustion cycle). Further, as in the previous embodiment discussed, a single one-way intake port is located in corner A (intake 51A) corner B (intake 51B), and corner C (intake 51B) of left vane cavity 100. However, this embodiment differs from the previous embodiment discussed in that there is only one exhaust port, head exhaust port 13, provided. As illustrated, head exhaust port 13 should be centered over right vane cavity 200 and have a diameter approximately equal to, or smaller than, the width of right vane 2R.

Figure 10:
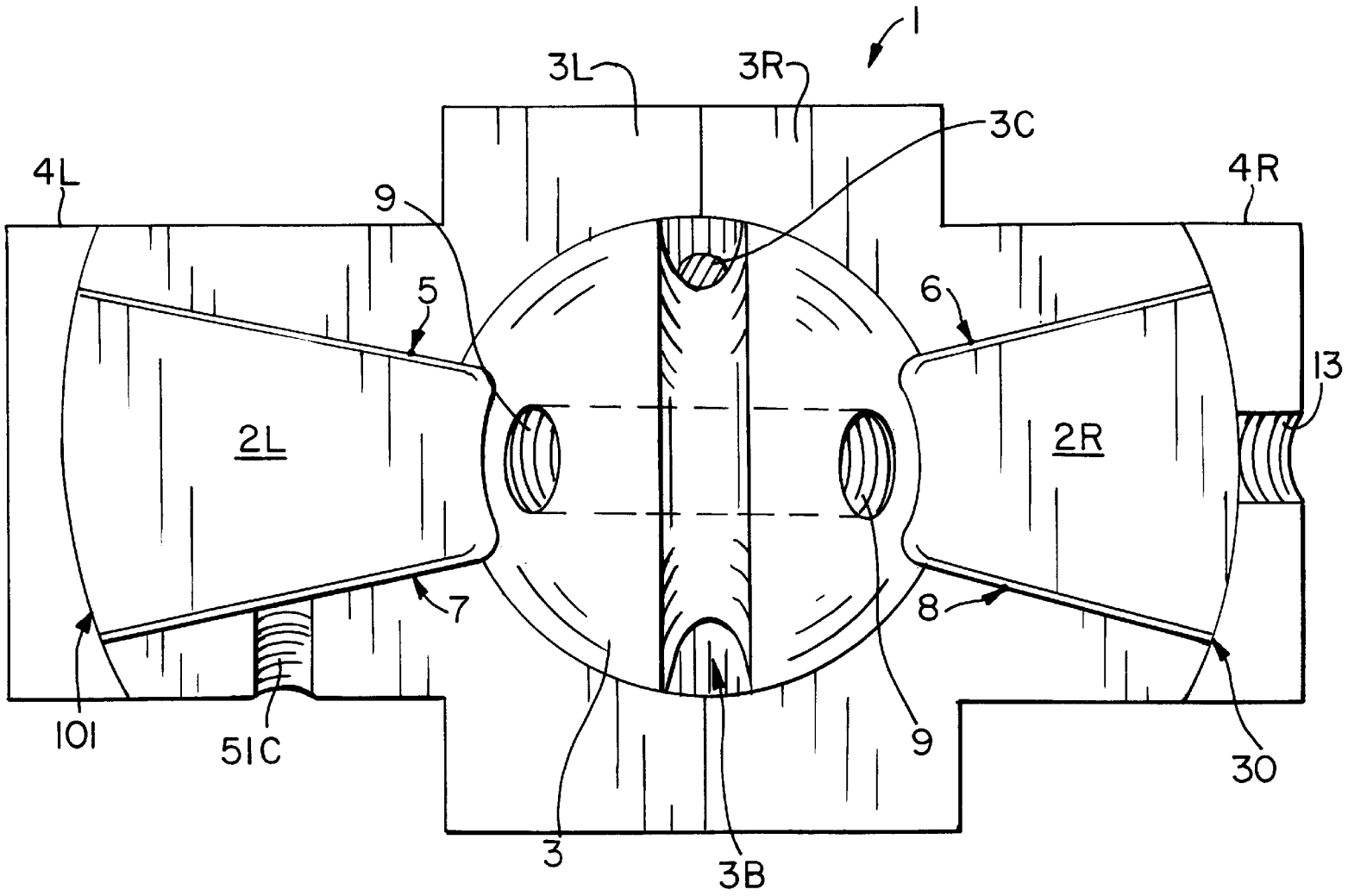
FIG. 10 provides a partial cut-away view of a fourth preferred embodiment of the instant invention, showing vanes and sphere from the side and remaining portions in cut-away section.
Figures 11A, 11B, 12A, 12B, 13A, 13B:
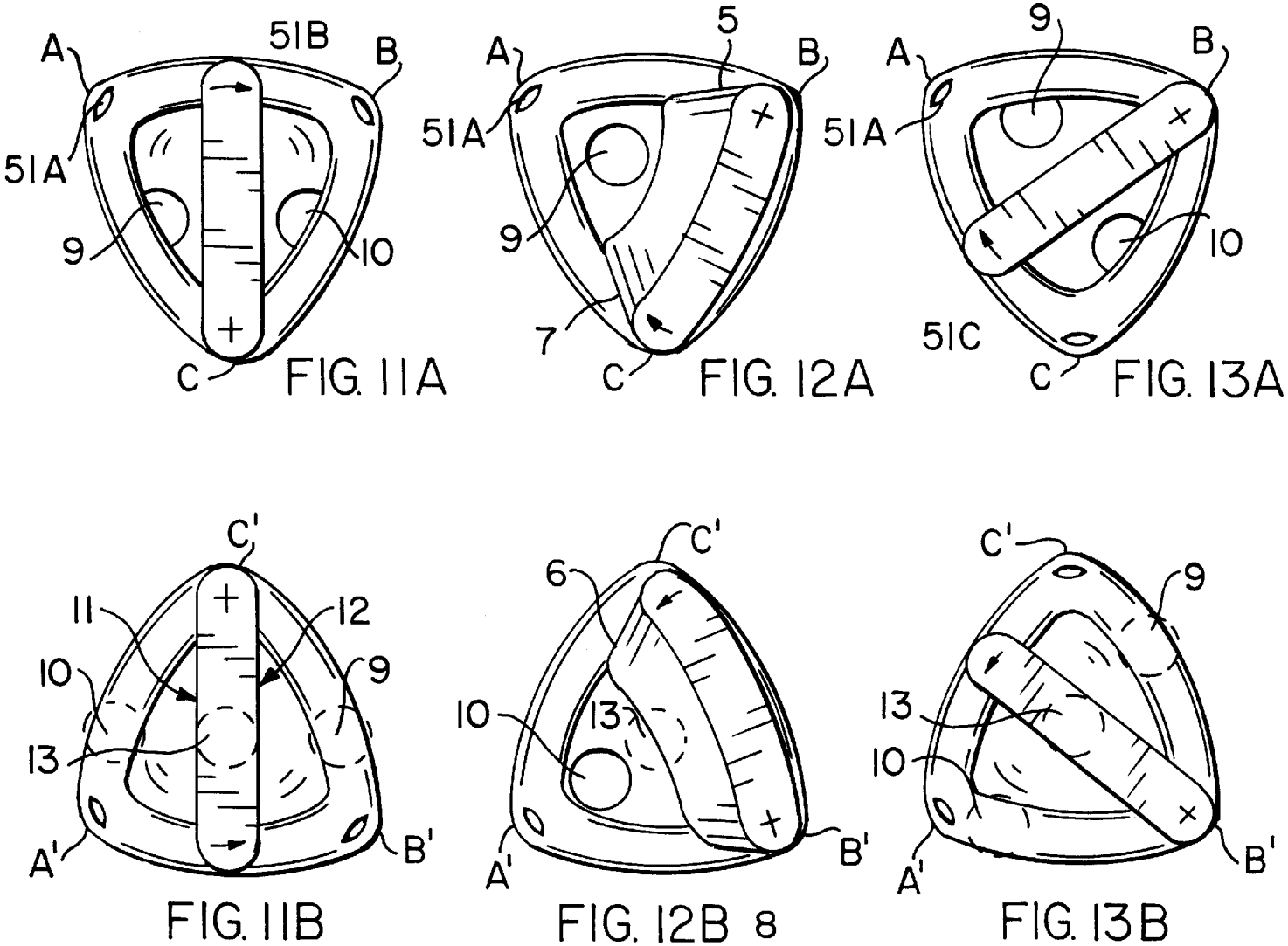
FIG. 11A provides a view from the left of the left vane cavity of a fourth preferred embodiment of the instant invention with the left vane in a first position.
FIG. 11B provides a view from the right of the right vane cavity of a fourth preferred embodiment of the instant invention at the same point in time as FIG. 11A, showing the right vane in a first position.
FIG. 12A provides a view from the left of the left vane cavity of a fourth preferred embodiment of the instant invention with the left vane in a second position.
FIG. 12B provides a view from the right of the right vane cavity of a fourth preferred embodiment of the instant invention at the same point in time as FIG. 12A, showing the right vane in a second position.
FIG. 13A provides a view from the left of the left vane cavity of a fourth preferred embodiment of the instant invention with the left vane in a third position.
FIG. 13B provides a view from the right of the right vane cavity of a fourth preferred embodiment of the instant invention at the same point in time as FIG. 13A, showing the right vane in a third position.
Figure 15A:
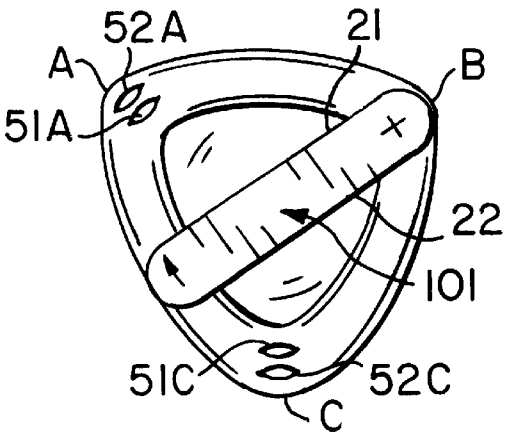
FIG. 15A provides a view from the left of the left vane cavity of the first preferred embodiment of the instant invention showing the left vane in a second position.

The operation of the embodiment illustrated in FIG. 10 may best be understood through review of FIGS. 11A through 13B. FIGS. 11A and 11B illustrate left vane 2L pivoting on side 7 while right vane 2R pivots on side 6 while sweeping, respectively, towards corner B and corner B'. During this portion of the engine cycle, air is taken in through the one-way intake 51A located at corner A into left vane cavity 100, while compressing air from left vane cavity 100 into second port hole 10. When the movement of the vanes reaches the center of their strokes (as illustrated in FIGS. 11A and 11B), four events take place simultaneously: (1) The second port hole 10 will begin to open into right vane cavity 200, letting pressurized air enter right vane cavity 200 on vane side 11, while displacing exhaust gases through exhaust port 13; (2) the right vane 2R will simultaneously begin to pass and expose exhaust port 13, allowing gases received in right vane cavity 200 on vane side 11 to be exhausted therethrough; (3) first port 9 will close, starting the compression stroke on vane side 12 of right vane cavity 200; and (4) exhaust port 13 will be closed as to portion of vane cavity 200 on vane side 12, allowing the compression stroke to begin. As left vane 2L and right vane 2R pivot in corners B and B' (as illustrated in FIGS. 12A and 12B) and begin rotating toward corners A and A' (as illustrated in FIGS. 13A and 13B), gas or diesel fuel is injected and the power stroke begins. This design allows six power strokes per revolution of sphere 3.

The four stroke internal combustion engine embodiment illustrated in FIG. 1 and FIGS. 14A through 17B is, like the previous embodiment discussed, characterized by six power strokes per revolution of sphere 3. As with the single stage air compressor shown in FIG. 2, it has one intake valve and one exhaust valve in each corner of left vane cavity 100 and in each corner of right vane cavity 200. These valves would be opened and closed by timed cams (not shown) in the manner familiar to those of ordinary skill in the arts pertaining to conventional four cycle internal combustion engines.

Figure 14A:
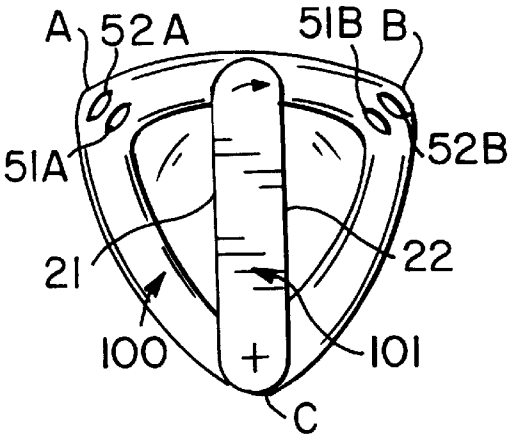
FIG. 14A provides a view from the left of the left vane cavity of the first preferred embodiment of the instant invention illustrated in FIG. 1, showing the left vane in a first position.
Figure 15B:
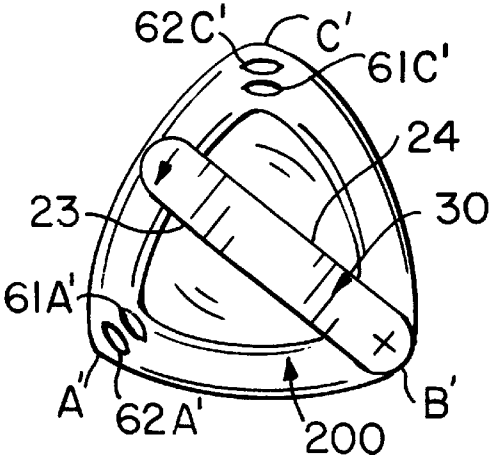
FIG. 15B provides a view from the right of the right vane cavity of the first preferred embodiment of the instant invention at the same point in time as FIG. 15A, showing the right vane in a second position.
Figure 14B:
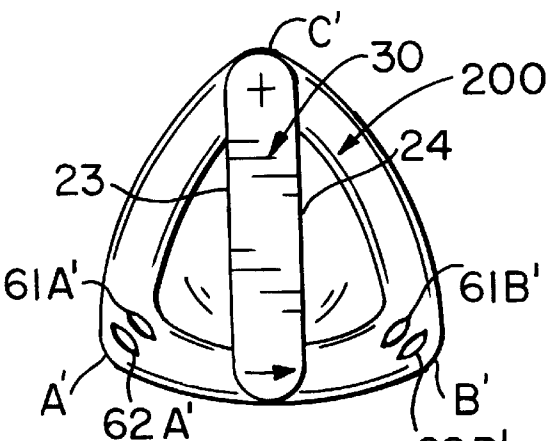
FIG. 14B provides a view from the right of the right vane cavity of the first preferred embodiment of the instant invention at the same point in time as FIG. 14A, showing the right vane in a first position.
Figure 16A:
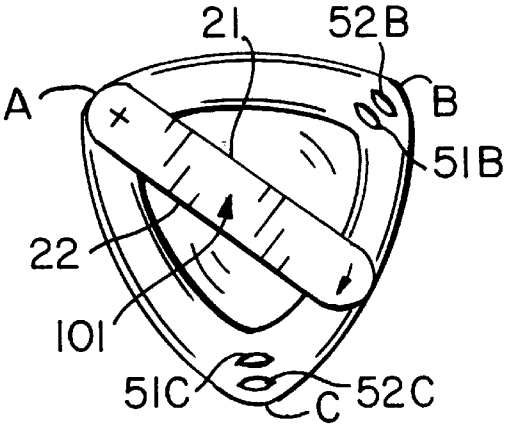
FIG. 16A provides a view from the left of the left vane cavity of the first preferred embodiment of the instant invention showing the left vane in a third position.
Figure 17A:
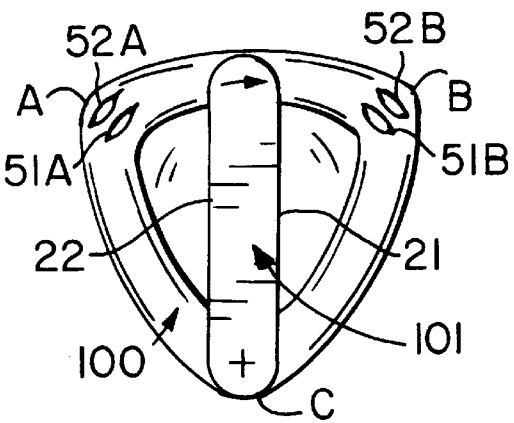
FIG. 17A provides a view from the left of the left vane cavity of the first preferred embodiment of the instant invention, showing the left vane in a fourth position.
Figure 16B:
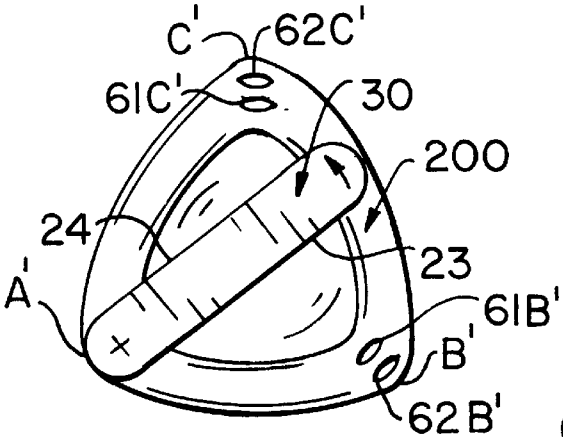
FIG. 16B provides a view from the right of the right vane cavity of the first preferred embodiment of the instant invention at the same point in time as FIG. 16A, showing the right vane in a third position.
Figure 17B:
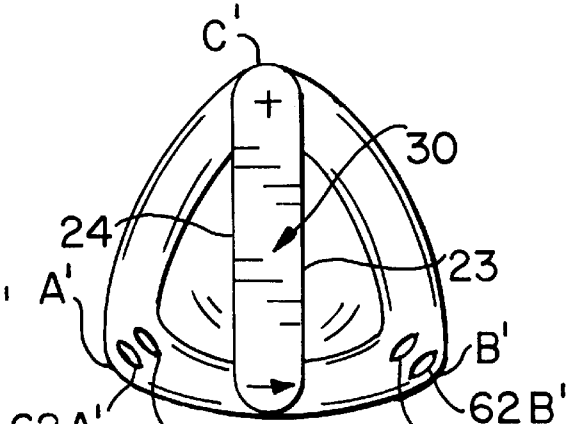
FIG. 17B provides a view from the right of the right vane cavity of the first preferred embodiment of the instant invention at the same point in time as FIG. 17A, showing the right vane in a fourth position.

The operation of this embodiment can best be understood by review of FIGS. 14A through 17B in sequence. First, as illustrated in FIG. 14A, as left vane 2L moves toward corner B vane side 21 is on the intake stroke while vane side 22 is on the exhaust stroke. Simultaneously, as shown in FIG. 14B, vane 2R moves toward corner B', with vane side 23 on its power stroke while vane side 24 is on its compression stroke. Second, in FIG. 15A, vane 2L is shown moving toward corner A with vane side 21 on the compression stroke and vane side 22 in the intake stroke. Meanwhile, as shown in FIG. 15B, vane 2R moves toward corner A' with vane side 23 on the exhaust stroke and vane side 24 in its power stroke. Third, as shown in FIG. 16A, as vane 2L moves toward corner C, vane side 21 is in its power stroke while vane side 22 is in its compression stroke. Simultaneously, as shown in FIG. 16B, as vane 2R moves toward corner C', vane side 23 is on its intake stroke, while vane side 24 is on its exhaust stroke. Fourth, as shown in FIG. 17A, as vane 2L moves toward corner B, vane side 21 is on its exhaust stroke and vane side 22 is on its power stroke. Meanwhile, as illustrated in FIG. 17B, vane 2R moves toward corner B' with vane side 23 on its compression stroke and vane side 24 on its intake stroke.

Figure 18:
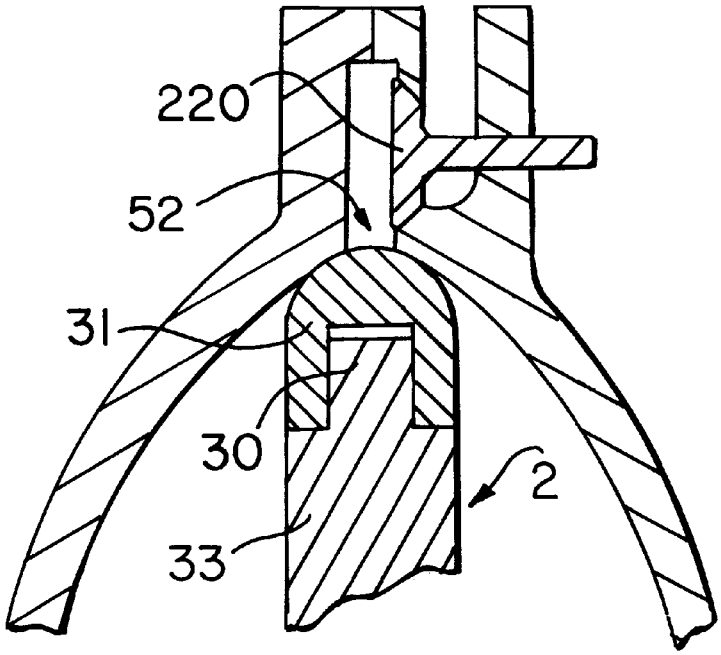
FIG. 18 provides a cross-sectional view of the corner of a vane cavity with vane and valve associated therewith.
Figure 19:
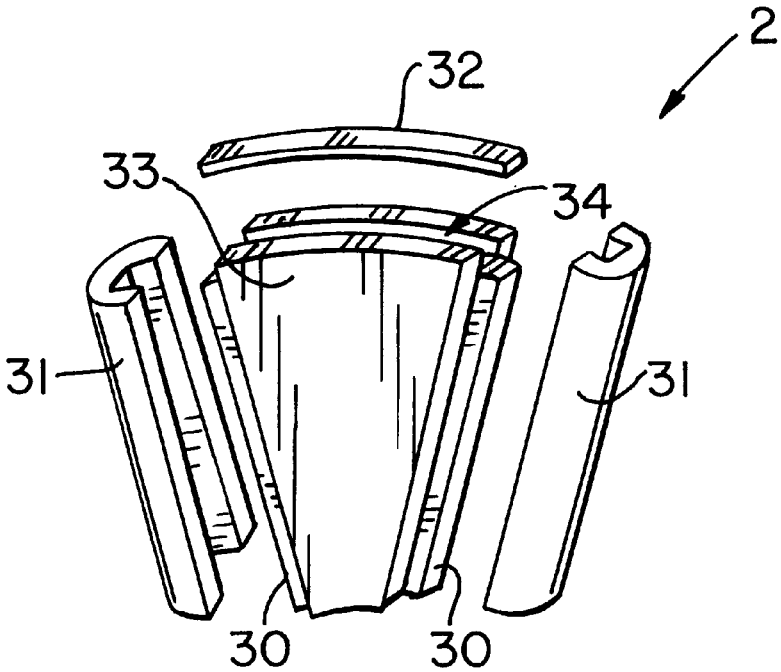
FIG. 19 provides an exploded view of a first preferred embodiment of a vane for use with the instant invention.
Figure 20:
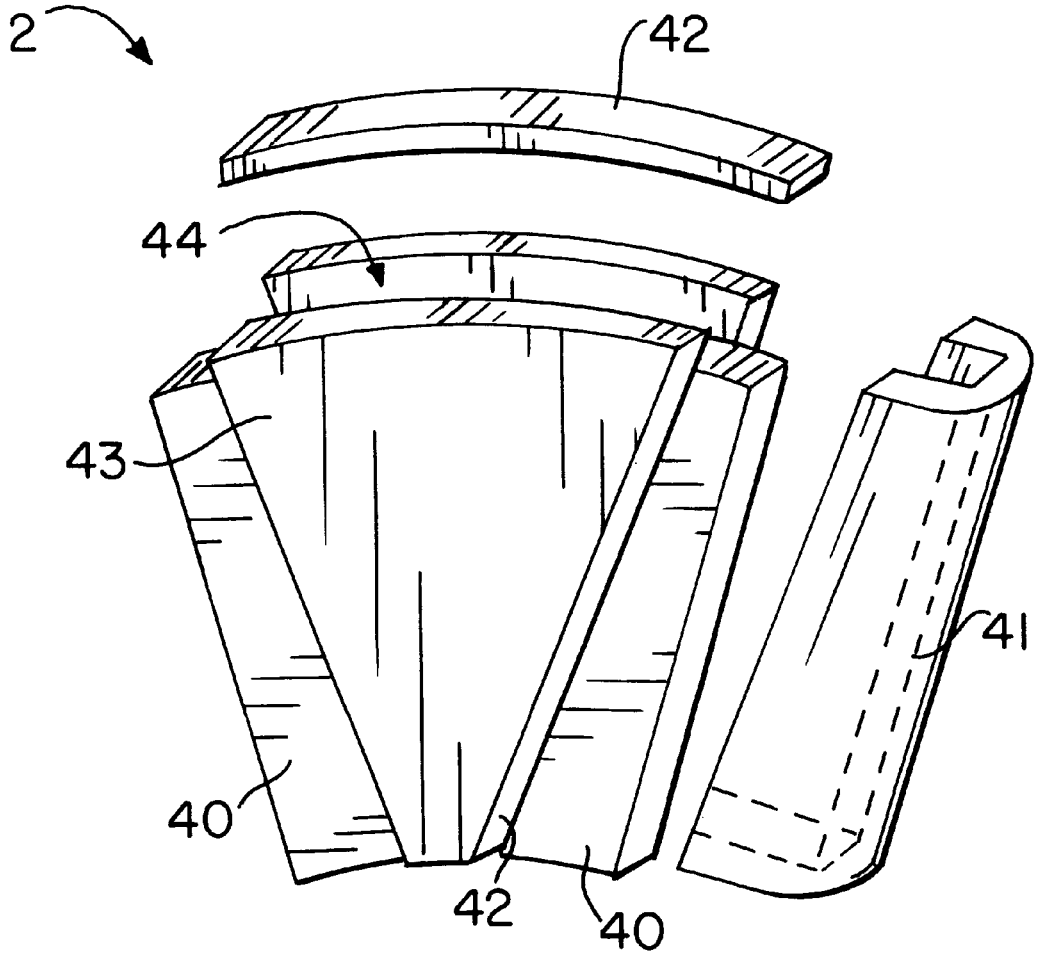
FIG. 20 provides an exploded view of a second preferred embodiment of a vane for use with the instant invention.

Additional detail regarding preferred designed features in the elements previously discussed is provided in FIGS. 18 through 20. FIG. 18 is a cross-sectional view of a corner of a vane cavity providing additional detail regarding placement of a valve 220, an intake/exhaust aperture 52, and other features for an internal combustion engine such as the four cycle engine just discussed. A more complete understanding of the preferred structure for a vane to be utilized in this invention may be derived from FIG. 19 (which provides an exploded perspective view of a vane 2) in conjunction with prior illustrations. As will be noted, vane 2 has a body member 33 advantageously provided with a raised boss 30. A vane side seal 31, which may advantageously be provided with a matching groove, can then be fitted onto the raised boss 30 of vane 2. The vane side seal 31 should ideally be spring loaded so as to help provide a seal between it and the wall of the vane cavity. The top of vane 2 may also, advantageously, be provided with a seal strip 32 with a curve matching the top of the vane 2 that fits into a matching groove 34 in the top of the vane 2. It should, like the vane side seals 31, ideally be spring loaded so as to provide a seal between the top of the vane 2 and the head of the cavity in which it is placed. FIG. 20 shows another possible arrangement in which the vane body 43 is provided with side seals 41 (only one of which is shown) disposed on keys 40 in contact with slidable tapered surface 42 so that an upward movement of 41 would increase the distance between vane 43 and side surfaces. Being spring loaded, seal 41 would be self-adjusting for wear.

Numerous variations are possible without exceeding the ambit and scope of the inventive concept disclosed herein, which may be further understood in the light of the claims that follow.

I claim:

1. A fluid handling device, comprising:

(a) a body having an at least partially spherical plenum;

(b) an at least partially spherical member having a centerpoint, said at least partially spherical member being situated within said at least partially spherical plenum;

(c) a generally planar first vane member attached to a first side of said at least partially spherical member exterior said at least partially spherical plenum, said first vane member lying generally within a hypothetical plane containing said centerpoint; and (d) a first cavity proximate a first side of said at least partially spherical member, said first cavity having an exterior and an interior in which said first vane member is located.

2. A fluid handling device, as described in claim 1, further comprising:

(a) a generally planar second member attached to a second side of said at least partially spherical member exterior said at least partially spherical plenum, said second vane member lying generally within a first hypothetical plane containing said centerpoint; and (b) a second cavity proximate a second side of said at least partially spherical member, said second cavity having an exterior and an interior in which said second vane member is located.

3. A fluid handling device, as described in claim 1, wherein said first vane member has an outward edge essentially shaped like an arc between a first point and a second point on the surface of a first sphere, an inward edge essentially shaped like an arc between a third point and a fourth point on the surface of a second sphere where said second sphere is concentric with and smaller than said first sphere and said second edge lies in a plane containing said first edge, a first side edge that is generally parallel to a hypothetical line running between said first point and said third point and lying on a radii from said centerpoint, and a second side edge that is generally parallel to a hypothetical line running between said second point and said fourth point and lying on a radii from said centerpoint.

4. A fluid handling device, as described in claim 1, wherein the interior of said first cavity has three arcuate planar sides.

5. A fluid handling device, as described in claim 2, wherein the interior of said first cavity and said second cavity each have three arcuate planar sides.

6. A fluid handling device, as described in claim 3, wherein the interior of said first cavity has three arcuate planar sides.

7. A fluid handling device, as described in claim 4, wherein each of said arcuate planar sides is shaped like a portion of a conical surface.

8. A fluid handling device, as described in claim 5, wherein each of said arcuate planar sides is shaped like a portion of a conical surface.

9. A fluid handling device, as described in claim 6, wherein each of said arcuate planar sides is shaped like a portion of a conical surface.

10. A fluid handling device, as described in claim 9, wherein a cone having such a conical surface would have a side angle approximately equal to an angle defined by an intersection of a first hypothetical line segment connecting said first point to said third point and a second hypothetical line segment connecting said first point to said second point.

11. A fluid handling device, as describe in claim 2, wherein said first vane member has a larger area than said second vane member.

12. A fluid handling device, as described in claim 5, wherein said first vane member has a larger area than said second vane member.

13. A fluid handling device, as described in claim 8, wherein said first vane member has a larger area than said second vane member.

14. A fluid handling device, as described in claim 1, further comprising at least one channel between the interior and exterior of said first cavity.

15. A fluid handling device, as described in claim 2, further comprising at least one channel between the interior and exterior of said first cavity and at least one channel between the interior and exterior of said second cavity.

16. A fluid handling device, as described in claim 3, further comprising at least one channel between the interior and exterior of said first cavity.

17. A fluid handling device, as described in claim 2, further comprising at least one channel through said at least partially spherical member between said first cavity and said second cavity.

18. A fluid handling device, as described in claim 5, further comprising at least one channel through said at least partially spherical member between said first cavity and said second cavity.

19. A fluid handling device, as described in claim 8, further comprising at least one channel through said at least partially spherical member between said first cavity and said second cavity.

20. A fluid handling device, as described in claim 2, further comprising at least one channel between the interior and exterior of said first cavity, at least one channel between the interior and exterior of said second cavity, and at least one channel through said at least partially spherical member between said first cavity and said second cavity.

* * * * *